United States Patent [19]

Leach

[11] 4,244,300

[45] Jan. 13, 1981

[54] SHELVING SYSTEM OF VARIABLE SHELVES

[76] Inventor: I. Elton Leach, 1711 Stoner Ave., Los Angeles, Calif. 90025

[21] Appl. No.: 68,095

[22] Filed: Aug. 20, 1979

[51] Int. Cl.[3] ..... A47B 45/00

[52] U.S. Cl. ..... 108/116; 108/96; 108/144; 108/102

[58] Field of Search ..... 108/120, 116, 108/117, 118, 144, 93, 92, 101

[56] References Cited

U.S. PATENT DOCUMENTS

| | | | |
|---|---|---|---|
| 1,834,196 | 12/1931 | Woolley | 108/101 |
| 1,895,283 | 1/1933 | Friedemann | 108/96 |
| 2,556,922 | 6/1951 | Hudson | 108/101 |
| 2,664,298 | 12/1953 | Shelby | 248/164 X |
| 2,891,679 | 6/1959 | Maupin | 108/93 |
| 3,044,197 | 7/1962 | Cook | 108/93 X |
| 3,329,104 | 7/1967 | Gittings | 108/117 |
| 4,099,814 | 7/1978 | Hasselberger | 108/92 |

FOREIGN PATENT DOCUMENTS

| | | | |
|---|---|---|---|
| 528039 | 8/1921 | France | 248/164 |

*Primary Examiner*—Francis K. Zugel
*Attorney, Agent, or Firm*—W. Edward Johansen

[57] ABSTRACT

The present invention is a shelving system for storing cans in a pantry so that the labels on the cans are visible. The shelving system includes a plurality of identical variable shelves. Each variable shelf includes a pair of platforms on which the cans are placed and each of which has a bore at one end and a mount on which both platforms are slideably coupled and which has a pair of slots that are aligned with the bores of the platforms. Each variable shelf also includes a pair of supports which are mechanically coupled to the mount by a hinge and are disposed so that the supports intersect each other and a mechanism for adjusting and maintaining the height of the platforms and mount which is determined by the variable point of intersection of the supports. The variable shelves can be placed in serial so that their sides are adjacent to each or in parallel so that the height of each mount is higher the closer it is to the back of the pantry.

1 Claim, 5 Drawing Figures

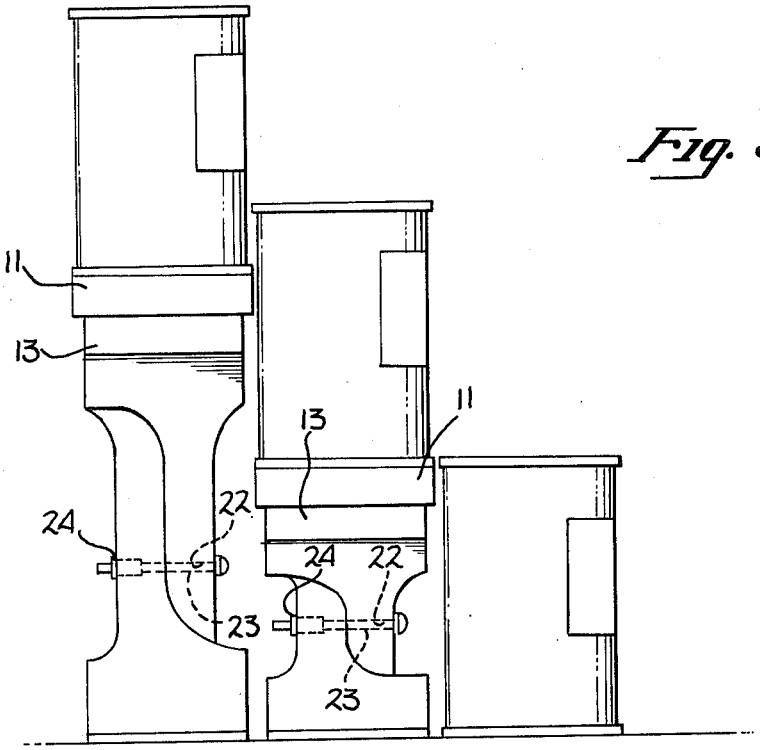
Fig. 3
Fig. 4
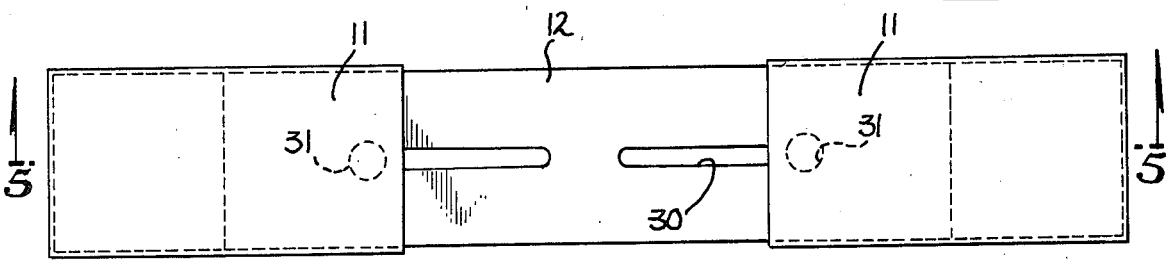
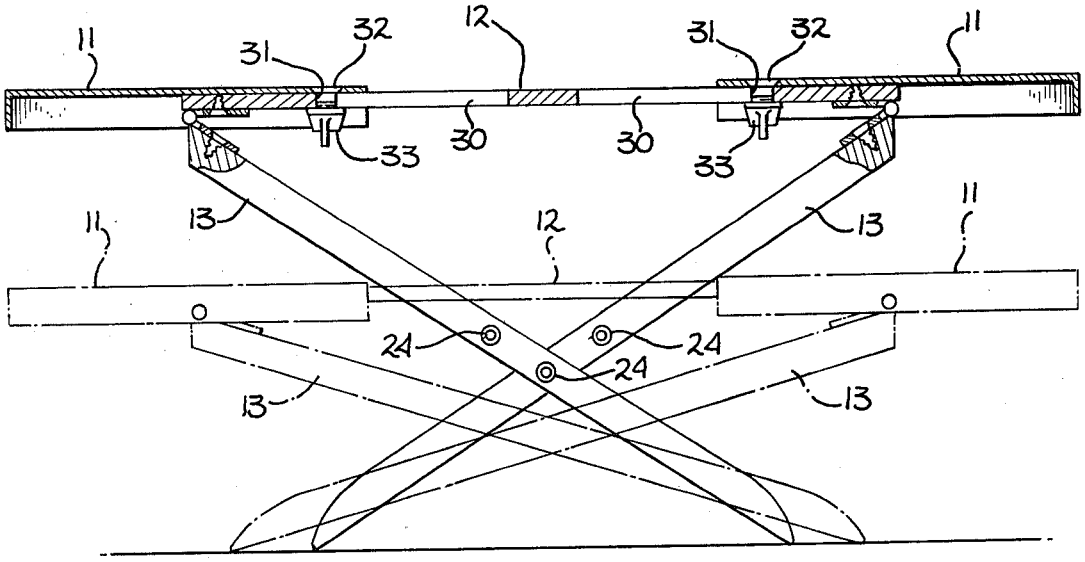
Fig. 5

SHELVING SYSTEM OF VARIABLE SHELVES

BACKGROUND OF THE INVENTION

1. Field of the Invention

The present invention relates to a shelving system for a pantry and more particularly to a shelving system which includes a set of variable shelves, which are identical, that can be arranged in a plurality of ways to provide optimum visibility of the labels of the cans in storage within the pantry.

2. Description of the Prior Art

U.S. Pat. No. 4,155,312, entitled Expandable Shelf, issued to Joel B. Thorkildson on May 22, 1979, teaches a two piece lengthwise adjustable shelf adapted to be mounted between two structural members, which includes a first sheet member having a generally rectangular planar surface of a predetermined length and width with a first integrally formed lip extending perpendicular to the planar surface along a first longitudinal edge thereof, and a second integrally formed lip extending perpendicular to the planar surface along a second longitudinal edge thereof in a direction opposite to the first lip and including a generally U-shaped portion therealong, there is a predetermined spacing between opposed legs of the U-shaped portion slightly greater than the thickness of the first sheet member and an integrally formed end tab extending perpendicular to the planar surface along one transverse edge thereof. The adjustable shelf also includes a second sheet member having a generally rectangular planar surface of a predetermined length and width and a thickness generally equal to the the thickness of the first sheet member with a first integrally formed U-shaped lip extending perpendicular to the planar surface along a first longitudinal edge thereof. There is a predetermined spacing between opposed legs of the U-shaped lip slightly greater than the thickness of the second sheet member. A second integrally formed lip extends perpendicular to the planar surface along a second longitudinal edge thereof in a direction opposite the first lip and includes an edge portion therealong. An integrally formed end tab extends perpendicular to the planar surface along one transverse edge thereof. The arrangement is such that the first lip on the first member is slidably engageable between the spaced apart legs of the U-shaped portion on the second member when the edge portion on the second member is slidingly engageable between the spaced apart legs of the U-shaped lip on the first member.

U.S. Pat. No. 4,145,977, entitled Modular Shelf System with Assembly-Disassembly Feature issued to Bernard Yellin on Mar. 27, 1979, teaches a shelf system composable of modular elements, the combination of a pair of shelf modules placed one above the other. Each of the shelf modules has a plurality of generally rectangular through vertical openings formed by depending wall portions and a plurality of column modules disposed between adjacent shelf modules. One end of each column module is hollow and has formed on opposite walls two internal opposed confronting detent shoulders. Each of the walls is inwardly offset to form a support surface for a shelf module. The one end is received in a vertical opening of the shelf with the shelf resting on the support surface. The opposite end of each column module has a pair of longitudinally extending opposed fingers, each terminating in a barb. The fingers are inwardly offset to form shelf engaging surfaces, and are adapted to be received in the hollow end of an adjoining column module so that the barbs mechanically interlock with respective detent shoulders to connect adjoining column modules while retaining a shelf module between the support surface and the shelf engaging surface.

U.S. Pat. No. 4,151,803, entitled Knock Down Corrugated Board Floor Display on May 1, 1979, teaches a knock down corrugated board display device which in its erected state includes a vertically disposed rear wall and vertically disposed side walls hingedly joined to said rear wall adjacent the side edges thereof; a multiplicity of spaced apart shelves each hingedly joined to the rear wall, the display device being collapsible with each shelf pivoting upwardly to lie generally parallel to the rear wall and with the side walls pivoting inwardly to lie generally parallel to said rear wall sandwiching shelves between side and rear walls; and a rope positioned under each shelf from side wall to side wall and secured to each side wall, each said rope being under tension when the shelf there above is extended to a horizontal position, the tension being created by contact of the lateral side edges of the shelf immediately above said rope with the side walls, each said rope serving to support a shelf thereabove and whatever may be on the shelf.

U.S. Pat. No. 4,150,629, entitled Organizer, issued to Arnold E. Santi on Apr. 24, 1979, teaches a non free standing organizer for storing horizontally insertable assorted household items, namely kitchen utensils, in horizontally accessible compartments, said organizer being insertable within a horizontally accessible unit having a horizontal shelf panel, portions of which directly support the stored items and portions of which support said organizer and further having first and second vertical shelf panels extending upwardly from the horizontal shelf panel for limiting the longitudinal extension of said organizer and thereby providing lateral support for said organizer, said organizer comprising in combination; a continuous length of bendable wire mesh material folded into a repetitive pattern of an upper horizontally oriented element, a vertically oriented element and a lower horizontally oriented element, said vertically oriented element being greater in width than said upper and lower horizontally oriented elements whereby adjacent pairs of said vertically oriented elements define opposed sides and the top or bottom sides respectively of each horizontally accessible compartment of said organizer, each said compartment thereby having a greater height than width, each said lower horizontally oriented element being locatable upon the horizontal shelf panel to receive support for and transmit support to the connected ones of said vertically oriented elements; whereby, said organizer compartmentalizes the horizontally accessible unit into a plurality of individually accessible compartments having vertical segregating elements for separating items stored within different ones of said individually accessible compartments.

SUMMARY OF THE INVENTION

In view of the foregoing factors and conditions characteristic of the prior art it is a primary object of the present invention to provide a shelving system which not only increases the storage space for cans of a pantry, but which also increases the visibility of the labels of the cans.

It is another object of the present invention to provide a shelving system which includes a plurality of variable shelves, which are identical, that may be adapted for any configuration, i.e. height, width and depth, of a pantry.

In accordance with an embodiment of the present invention a shelving system for storing cans in a pantry so that the labels on the cans are visible is described. The shelving system includes a plurality of identical variable shelves. Each variable shelf includes a pair of platforms on which the cans are placed and each of which has a bore at one end and a mount on which both platforms are slideably coupled which has a pair of slots that are aligned with the bores of the platforms. Each variable shelf also includes a pair of supports which are mechanically coupled to the mount by a hinge and are disposed so that the supports intersect each other and a mechanism for adjusting and maintaining the height of the platforms and mount which is determined by the variable point of intersection of the supports. The variable shelves can be placed in serial so that their sides are adjacent to each or in parallel so that the height of each mount is higher the closer it is to the back of the pantry.

The features of the present invention which are believed to be novel are set forth with particularity in the appended claims.

Other objects and many of the attendant advantages of this invention will be more readily appreciated as the same becomes better understood by reference to the followed detailed description and considered in connection with the accompanying drawing in which like reference symbols designate like parts throughout the figures.

DESCRIPTION OF THE DRAWING

FIG. 3 is a side elevational view of the variable shelves of FIG. 1 taken along the line 3—3 of FIG. 2.

FIG. 4 is a top plan view of one of the variable shelves of FIG. 1.

FIG. 5 is a side elevational cross-sectional view of one of the variable shelves of FIG. 1.

DESCRIPTION OF THE PREFERRED EMBODIMENT

Figure 1:
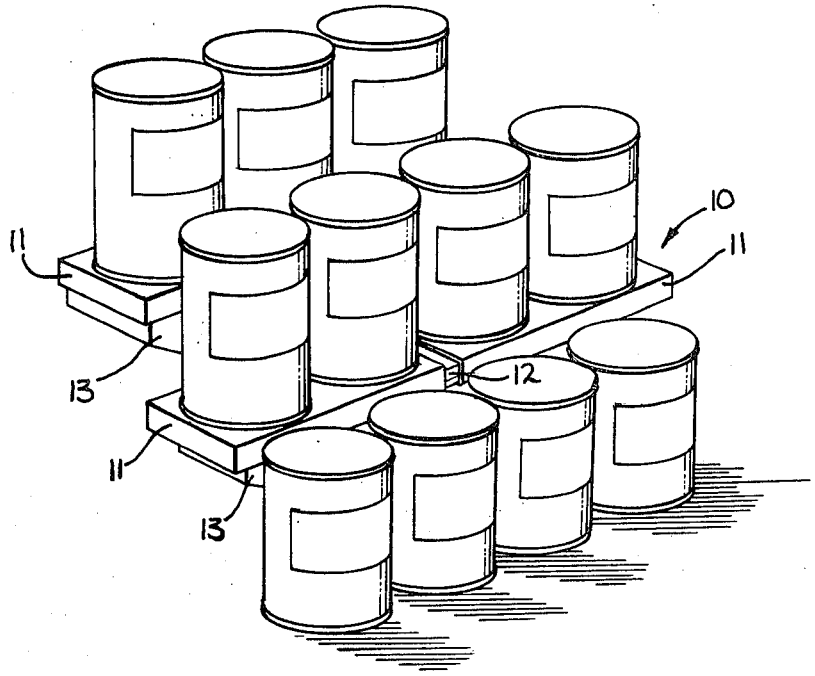
FIG. 1 is a perspective drawing of a pair of variable shelves which have been constructed in accordance with the principles of the present invention and which have a plurality of cans placed thereon.

In order to best understand the present invention it is necessary to refer to a description of its preferred embodiment in conjunction with the accompanying drawing. Referring to FIG. 1 two variable shelves 10 have a plurality of cans placed thereon. Each variable shelf 10 includes a pair of platforms 11 on which the cans are placed, a mount 12 on which the platforms 11 are mounted, and a pair of supports 13 which support the mount 12 and the pair of platforms 11 and which are slideably coupled to the mount 11 so that the height thereof is adjustable.

Figure 2:
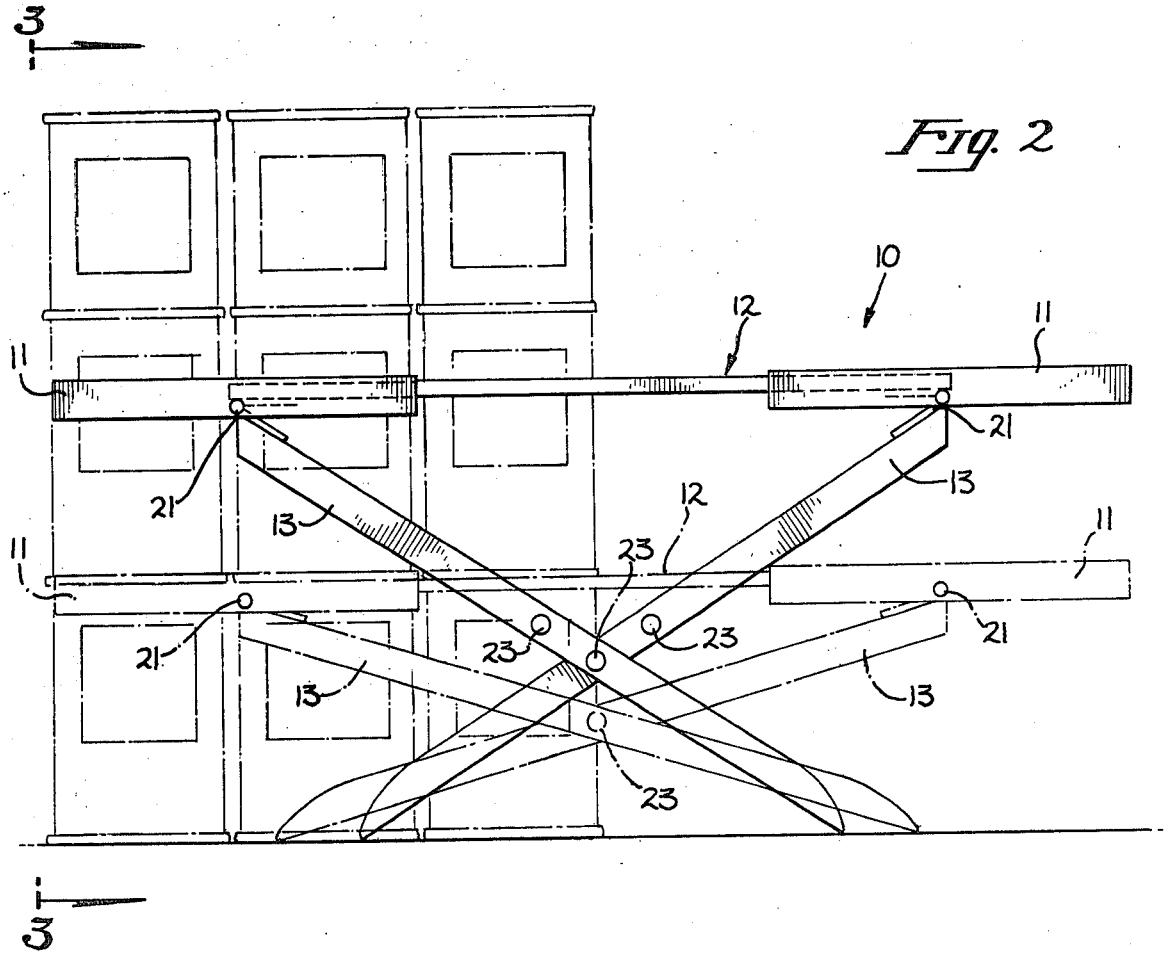
FIG. 2 is a rear elevational view of the variable shelves of FIG. 1.

Referring to FIG. 2 each support 13 is mechanically coupled to the mount 12 by a hinge 21.

Referring to FIG. 3 in conjunction with FIG. 2, each support 12 has a plurality of holes 22 which are adapted to receive a screw 23 and a threaded insert 24 in order to secure the position of the supports 13 after they have been adjusted.

Referring now to FIG. 4 in conjunction with FIG. 5, the mount 12 has a pair of slots 30 and each of the pair of platforms 11 has a bore 31 which is aligned with one of the slots 30. The bores are adjustably coupled to the slots by a screw 32 and a wing-nut 33.

From the foregoing it can be seen that a variable shelf has been described. Among the advantages of the variable shelf are that space in a pantry may be more fully utilized without the user losing track of the cans which he has stored. Another advantage is that not only is the variable shelf inexpensive to make, but a set of four or more variable shelves, all of which are identical, can be used to greatly increase storage space in a pantry of any particular height or width in that the sides of the variable sleeves may be lined up adjacent to each other or parallel to each other.

Furthermore, it should be noted that the figures of the drawing have not been drawn to scale and that distances of and between the figures are not to be considered significant.

Accordingly, it is intended that the foregoing disclosure and showings made in the drawing shall be considered as illustrations of the principles of the present invention.

What is claimed is:

1. A shelving system for storing cans in a pantry so that the labels on the cans are visible, said shelving system comprising a plurality of identical variable shelves, each of said variable shelves comprising:

a. a platform on which the cans are placed and which has a slot at each end;

b. a pair of rectangular members, each of which has a bore at one end and is mechanically coupled to said platform at one of its ends with said bore being aligned with a corresponding slot of said platform whereby an adjustable platform is formed; and c. variable supporting means for supporting said adjustable platform at an adjustable height, said supporting means comprising:

a pair of supports;

a pair of hinges, each of said hinges pivotally coupling an end of one of said pair of supports to one of said rectangular members: and maintaining means for maintaining the point of intersection of said pair of supports, said maintaining means comprising a pin; and a plurality of holes which are drilled in each of said pair of supports and which are mechanically coupled together by said pin.

* * * * *